US006282903B1

(12) United States Patent
Russell

(10) Patent No.: US 6,282,903 B1
(45) Date of Patent: Sep. 4, 2001

(54) CONDENSER AUGMENTATION DEVICE FOR A STEAM-POWERED SYSTEM

(76) Inventor: Fred Russell, 2403 Century Hill, Los Angeles, CA (US) 90067

( * ) Notice: Subject to any disclaimer, the term of this patent is extended or adjusted under 35 U.S.C. 154(b) by 0 days.

(21) Appl. No.: 09/698,957

(22) Filed: Oct. 30, 2000

(51) Int. Cl.[7] ..... F01K 1/00
(52) U.S. Cl. ..... 60/659; 60/670
(58) Field of Search ..... 60/670, 659, 643

(56) References Cited

U.S. PATENT DOCUMENTS 1,867,876 * 7/1932 Clark .
2,676,470 * 4/1954 Streitz .
3,822,592 * 7/1974 Siegel et al. .
4,570,443 * 2/1986 Specht ..... 60/670
4,873,829 * 10/1989 Williamson ..... 60/670
5,092,127 * 3/1992 Miller ..... 60/670 X

* cited by examiner

*Primary Examiner*—Hoang Nguyen
(74) *Attorney, Agent, or Firm*—David A. Belasco; Beehler & Pavitt

(57) ABSTRACT

A condenser augmentation device for a steam-powered system is described. The system includes a steam boiler that has a condensate inlet and a steam outlet. The steam outlet is connected to an inlet of a steam-powered device. The steam-powered device has an exhaust outlet that is connected to a choke. The choke is connected to a condensing pipe that is routed to the condensate inlet of the boiler, forming a closed system. The choke contains an orifice that is of substantially smaller cross-section that either the exhaust outlet or the condensing pipe. By passing the exhaust steam through the orifice, the flow is reduced, resulting in rapid expansion, cooling and condensation of the exhaust steam, thus permitting a condensing pipe of a shorter length to be used. The choke may take several forms. The choke may be adapted to accept choke plates having various sized orifices. An adjustable, screw-operated choke plate may be connected to an operating handle or it may be remotely operable by means of an electrical solenoid or stepping motor.

4 Claims, 1 Drawing Sheet

CONDENSER AUGMENTATION DEVICE FOR A STEAM-POWERED SYSTEM

FIELD OF INVENTION

The invention pertains to devices for steam-powered systems. More particularly, the invention relates to devices for improving the efficiency of condenser operations for steam-powered systems.

BACKGROUND OF THE INVENTION

The central principle utilized by the invention relates to a reduction in the size of an outlet orifice from a steam-powered device. By passing the outlet steam through such a reduced size orifice and permitting the steam to expand into a larger pipe or vessel downstream from the orifice, the steam will be cooled and condensed to a liquid state. Various devices have been developed using a reduced size outlet orifice to control and affect the flow of a stream through a pipe.

U.S. Pat. No. 4,105,721 issued to Schliebe incorporates a reduced size orifice in a venturi T-fitting in order to aerate a stream of water being recirculated in a swimming pool water filtration and heating system.

U.S. Pat. No. 3,822,592 issued to Siegel et al., employs a replaceable orifice member inserted in a passage of a head flow meter to induce a differential pressure that is sensed by a pressure capsule.

U.S. Pat. No. 2,676,470, issued to Streitz utilizes a reduced size orifice as an expansion valve and flow regulator between the compressor and the evaporator of a refrigerating system. The orifice design facilitates sufficient back pressure to reduce velocity refrigerant intake through the orifice resulting in substantially balanced or equilibrium condition after the system once reaches normal operating temperature, holding the temperature constant near normal for longer periods of time, reducing the frequency of operation of the compressor.

U.S. Pat. No. 1,867,876 issued to Clark employs a reduced size orifice in an eductor in which an operating medium of liquid under pressure flows through the orifice to produce a high velocity jet which is used to entrain granular material, such as sand, and to project the same into a body consisting of a mouth, a tapered discharge nozzle or throat-piece and outlet chamber.

While other variations exist, the above-described inventions involving reduced size orifices are typical of those encountered in the prior art. It is an objective of the present invention to provide a means to rapidly cool the outlet flow from a steam-powered device. It is a further objective to cool this outlet flow to the point where the steam will be quickly condensed to a liquid. It is a still further objective of the invention to reduce the required length of condensing piping needed to return the steam to a liquid state. It is yet a further objective to provide the above-described capabilities in an inexpensive and durable device that is capable of extended duty cycles and that may be easily repaired and maintained.

While some of the physical characteristics of the present invention are disclosed in the prior art, none of the inventions found include the expanding of steam to reduce its temperature to facilitate its conversion from steam to condensate.

SUMMARY OF THE INVENTION

A condenser augmentation device for a steam-powered system providing the desired features may be constructed from the following components. A boiler is provided. The boiler includes a condensate inlet, a pressure vessel, a means for heating the pressure vessel, means for controlling the heating, means for maintaining a steady flow of steam from the boiler, and a steam outlet. A steam driven device including a steam inlet and an exhaust outlet is provided. The steam inlet is connected to the steam outlet of the boiler. The exhaust outlet is of a first predetermined cross-section. A choke having an inlet end, an outlet end and a second cross-section is attached at its inlet end to the exhaust outlet of the steam driven device.

A condensing line is provided. The condensing line has an inlet end, an outlet end and a third predetermined cross-section. The condensing line is connected at its inlet end to the outlet end of the choke and is connected at its outlet end to the condensate inlet of the boiler. The third predetermined cross-section is larger than the second cross-section. A working fluid is provided. The working fluid is located within the pressure vessel of the boiler and is capable of being heated to a vapor stage in the pressure vessel. The working fluid is capable of being converted to a liquid condensate in the condensing line after powering the steam-driven device and passing through the choke.

The choke includes means of reducing the second cross-section to a size substantially smaller than the first and third predetermined cross-sections. The choke causes the working fluid vapor to cool and to condense by causing it to flow through the smaller second cross-section at a reduced volume but at a rate of speed to expand the vapor in the condensing line.

In a variant of the invention, the means of reducing the second cross-section to a size substantially smaller than the first and third predetermined cross-sections includes a removable choke plate. The choke plate is sized and shaped to fit sealably within the choke between the inlet end and the outlet end. The choke plate includes an orifice having a cross-section substantially smaller than the first and third predetermined cross-sections.

In a further variant, the means of reducing the second cross-section to a size substantially smaller than the first and third predetermined cross-sections includes an adjustable choke plate. The adjustable choke plate is located within the choke between the inlet end and the outlet end and is capable of varying the second cross-section between a first size and a second size. The adjustable choke plate is manually controllable by means of a threaded shaft. The shaft has an upper end and a lower end, and is attached at its lower end to an upper end of the choke plate. A sealed, threaded nut is attached to the choke and threadedly engages the shaft. An operating handle is fixedly attached to the upper end of the shaft.

When the handle is turned in a first direction the adjustable choke plate will change the second cross-section toward the first size and when the handle is turned in a second direction the adjustable choke plate will change the second cross-section toward the second size.

In yet a further variant of the invention, the adjustable choke plate is remotely controllable. In still a further variant, the adjustable choke plate is controlled by an electric solenoid. In a final variant the adjustable choke plate is controlled by an electrical stepping motor.

An appreciation of the aims and objectives of the present invention and an understanding of it may be achieved by referring to the accompanying drawings and the detailed description of a preferred embodiment.

DETAILED DESCRIPTION OF THE PREFERRED EMBODIMENT

Figure 1:
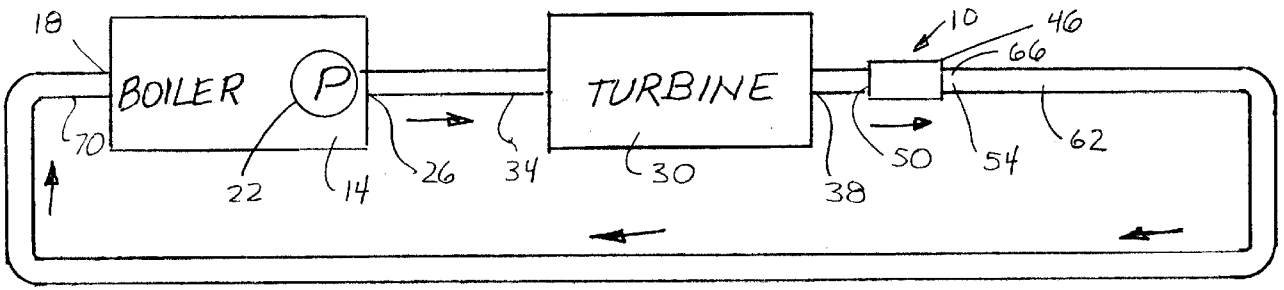
FIG. 1 is a schematic illustration of the preferred embodiment of the invention including a choke between the steam-driven device and the condensing line.
Figure 2:
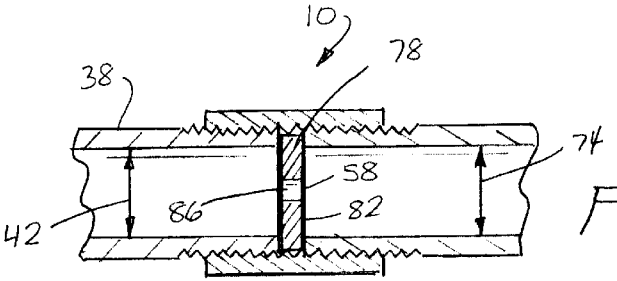
FIG. 2 is a cross-sectional side elevation of the choke of the FIG. 1 embodiment including a choke plate.

FIGS. 1 and 2 illustrate a condenser augmentation device for a steam-powered system 10 providing the desired features that may be constructed from the following components. A boiler 14 is provided. The boiler 14 includes a condensate inlet 18, a pressure vessel 22, a means for heating the pressure vessel (not shown), means for controlling the heating (not shown), means for maintaining a steady flow of steam from the boiler (not shown) and a steam outlet 26. A steam driven device 30 including a steam inlet 34 and an exhaust outlet 38 is provided. The steam inlet 34 is connected to the steam outlet 26 of the boiler 14. The exhaust outlet 38 is of a first predetermined cross-section 42. A choke 46 having an inlet end 50, an outlet end 54, and a second cross-section 58 is attached at its inlet end 50 to the exhaust outlet 38 of the steam driven device 30.

A condensing line 62 is provided. The condensing line 62 has an inlet end 66, an outlet end 70 and a third predetermined cross-section 74. The condensing line 62 is connected at its inlet end 66 to the outlet end 54 of the choke 46 and is connected at its outlet end 70 to the condensate inlet 18 of the boiler 14. The third predetermined cross-section 74 is larger than the second cross-section 58. A working fluid (not shown) is provided. The working fluid is located within the pressure vessel of the boiler 14 and is capable of being heated to a vapor stage in the pressure vessel. The working fluid is capable of being converted to a liquid condensate in the condensing line 62 after powering the steam driven device 30 and passing through the choke 46.

The choke 46 includes means 78 of reducing the second cross-section 58 to a size substantially smaller than the first and third predetermined cross-sections 42, 74. The choke 46 causes the working fluid vapor to cool and to condense by causing it to flow through the smaller second cross-section 58 at a reduced volume but at a rate of speed to expand the vapor in the condensing line 62.

Figure 3:
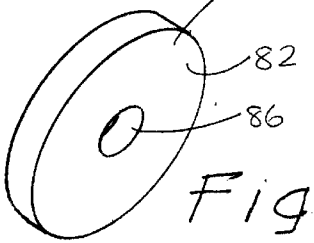
FIG. 3 is a perspective view of the choke plate.

In a variant of the invention, as illustrated in FIGS. 2 and 3, the means 78 of reducing the second cross-section 58 to a size substantially smaller than the first and third predetermined cross-sections 42, 74 includes a removable choke plate 82. The choke plate 82 is sized and shaped to fit sealably within the choke 46 between the inlet end 50 and the outlet end 54. The choke plate 82 includes an orifice 86 having a cross-section substantially smaller than the first and third predetermined cross-sections 42, 74.

Figure 4:
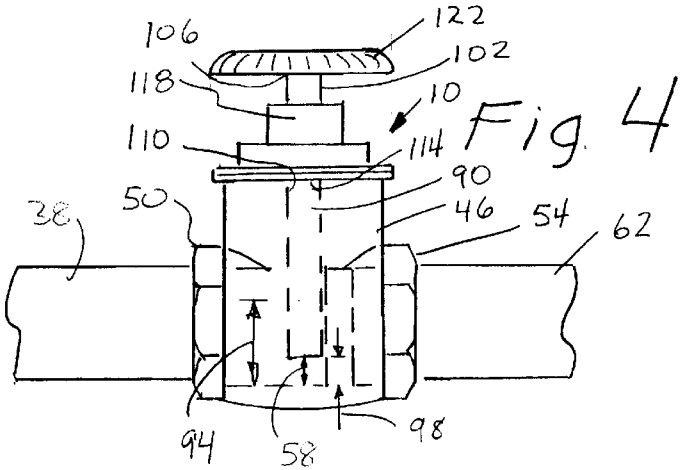
FIG. 4 is a side elevational view of a second embodiment of the invention including a manually operable adjustable choke plate.

In a further variant, as illustrated in FIG. 4, the means 78 of reducing the second cross-section 58 to a size substantially smaller than the first and third predetermined cross-sections 42, 74 includes an adjustable choke plate 90. The adjustable choke plate 90 is located within the choke 46 between the inlet end 50 and the outlet end 54 and is capable of varying the second cross-section 58 between a first size 94 and a second size 98. The adjustable choke plate 90 is manually controllable by means of a threaded shaft 102. The shaft 102 has an upper end 106 and a lower end 110, and is attached at its lower end 110 to an upper end 114 of the choke plate 90. A sealed, threaded nut 118 is attached to the choke 46 and threadedly engages the shaft 102. An operating handle 122 is fixedly attached to the upper end 106 of the shaft 102.

When the handle 122 is turned in a first direction the adjustable choke plate 90 will change the second cross-section 58 toward the first size and when the handle 122 is turned in a second direction the adjustable choke plate 90 will change the second cross-section 58 toward the second size.

Figure 5:
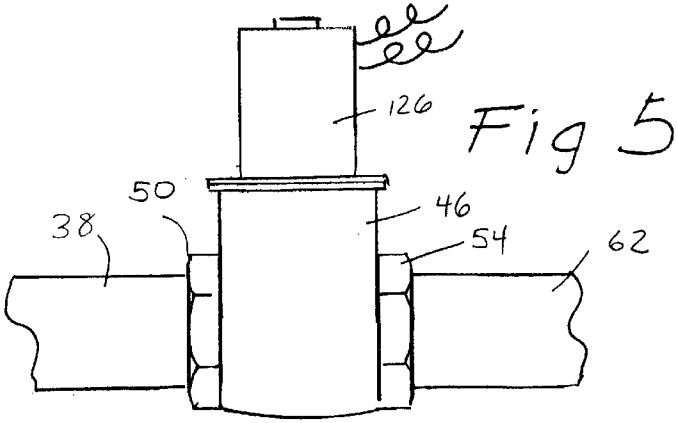
FIG. 5 is a side elevational view of a third embodiment of the invention including an electrically operable adjustable choke plate.

In yet a further variant of the invention, as illustrated in FIG. 5, the adjustable choke plate 90 is remotely controllable. In still a further variant, the adjustable choke plate 90 is controlled by an electric solenoid 126. In a final variant the adjustable choke plate 90 is controlled by an electrical stepping motor (not shown).

The condenser augmentation device for a steam-powered system 10 has been described with reference to particular embodiments. Other modifications and enhancements can be made without departing from the spirit and scope of the claims that follow.

What is claimed is:

1. A condenser augmentation device for a steam-powered system, comprising:

a boiler, said boiler including a condensate inlet, a pressure vessel, a means for heating said pressure vessel, means for controlling said heating, means for providing a steady flow of steam from said boiler, and a steam outlet;

a steam-driven device, said device including a steam inlet and an exhaust outlet, said steam inlet being connected to the steam outlet of the boiler;

said exhaust outlet being of a first predetermined cross-section;

a choke, said choke having an inlet end, an outlet end, a second cross-section and being attached at its inlet end to the exhaust outlet of the steam-driven device;

a condensing line, said condensing line having an inlet end, an outlet end, a third predetermined cross-section and being connected at its inlet end to the outlet end of the choke and being connected at its outlet end to the condensate inlet of the boiler;

said third predetermined cross-section being larger than said second cross-section;

a working fluid, said working fluid being disposed within the pressure vessel of said boiler and capable of being heated to a vapor stage therein and being capable of being converted to a liquid condensate in said condensing line after powering said steam-driven device and passing through said choke;

said choke including means of reducing the second cross-section to a size substantially smaller than said first and third pre-determined cross-sections;

said choke causing the working fluid vapor to cool and to condense by flowing through said smaller second cross-section at a reduced volume but at a rate of speed to expand the vapor in said condensing line;

said means of reducing the second cross-section to a size substantially smaller than the first and third pre-determined cross-sections further comprising:

an adjustable choke plate, said adjustable choke plate being disposed within said choke between said inlet end and said outlet end and capable of varying said second cross-section between a first size and a second size.

2. A condenser augmentation device for a steam-powered system as described in claim 1, wherein the adjustable choke plate is remotely controllable.

3. A condenser augmentation device for a steam-powered system as described in claim 2, wherein the adjustable choke plate is controlled by an electric solenoid.

4. A condenser augmentation device for a steam-powered system as described in claim 2, wherein the adjustable choke plate is controlled by an electrical stepping motor.

* * * * *